US010209639B2

(12) United States Patent
Asano et al.

(10) Patent No.: US 10,209,639 B2
(45) Date of Patent: Feb. 19, 2019

(54) PHOTOCONDUCTOR, IMAGE FORMING APPARATUS, AND PROCESS CARTRIDGE

(71) Applicants: Tomoharu Asano, Kanagawa (JP); Tetsuro Suzuki, Shizuoka (JP); Eiji Kurimoto, Shizuoka (JP); Daisuke Nii, Shizuoka (JP); Toshihiro Ishida, Shizuoka (JP)

(72) Inventors: Tomoharu Asano, Kanagawa (JP); Tetsuro Suzuki, Shizuoka (JP); Eiji Kurimoto, Shizuoka (JP); Daisuke Nii, Shizuoka (JP); Toshihiro Ishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/484,715

(22) Filed: Apr. 11, 2017

(65) Prior Publication Data

US 2017/0307988 A1 Oct. 26, 2017

(30) Foreign Application Priority Data

Apr. 25, 2016 (JP) ..... 2016-087269

(51) Int. Cl.
*G03G 5/14* (2006.01)
*G03G 5/06* (2006.01)
(Continued)

(52) U.S. Cl.
CPC ..... *G03G 5/144* (2013.01); *G03G 5/047* (2013.01); *G03G 5/0517* (2013.01);
(Continued)

(58) Field of Classification Search
CPC .... G03G 5/144; G03G 5/0696; G03G 5/0609; G03G 5/0612; G03G 5/0614
See application file for complete search history.

(56) References Cited

U.S. PATENT DOCUMENTS 4,672,149 A 6/1987 Yoshikawa et al.
4,871,635 A * 10/1989 Seki ..... G03G 5/142 430/60

(Continued)

FOREIGN PATENT DOCUMENTS

JP 06110236 A * 4/1994
JP 08110648 A * 4/1996

(Continued)

OTHER PUBLICATIONS

English language machine translation of JP 06-110236 (Apr. 1994).*

(Continued)

*Primary Examiner* — Christopher D Rodee
(74) *Attorney, Agent, or Firm* — Oblon, McClelland, Maier & Neustadt, L.L.P.

(57) ABSTRACT

A photoconductor including a conductive support, an undercoat layer, a charge-generating layer, and a charge-transporting layer, at least the undercoat layer, the charge-generating layer, and the charge-transporting layer being disposed on the conductive support in an order mentioned, wherein the undercoat layer includes a binder resin and metal oxide particles, and the charge-generating layer includes a binder resin, a titanyl phthalocyanine pigment, and a salicylic acid derivative.

4 Claims, 3 Drawing Sheets

(51) Int. Cl.
*G03G 5/047* (2006.01)
*G03G 15/00* (2006.01)
*G03G 5/05* (2006.01)

(52) U.S. Cl.
CPC ..... *G03G 5/0612* (2013.01); *G03G 5/0614* (2013.01); *G03G 5/0696* (2013.01); *G03G 5/142* (2013.01); *G03G 15/75* (2013.01)

(56) References Cited

U.S. PATENT DOCUMENTS 5,350,653 A 9/1994 Shoshi et al.
5,387,487 A 2/1995 Shoshi et al.
5,486,438 A 1/1996 Shoshi et al.
5,492,784 A 2/1996 Yoshikawa et al.
5,578,405 A 11/1996 Ikegami et al.
5,716,745 A * 2/1998 Minemura ..... G03G 5/142 430/31
5,723,243 A 3/1998 Sasaki et al.
5,747,204 A 5/1998 Anzai et al.
5,830,980 A * 11/1998 Anzai ..... C08G 64/12 430/59.6
5,840,454 A 11/1998 Nagai et al.
2003/0235769 A1* 12/2003 Zhu ..... C09B 67/0026 430/56
2004/0152000 A1* 8/2004 Zhu ..... G03G 5/047 430/59.5
2005/0221210 A1 10/2005 Suzuki et al.
2005/0287452 A1 12/2005 Tamura et al.
2006/0014096 A1 1/2006 Ohshima et al.
2006/0068308 A1 3/2006 Ohshima et al.
2006/0093955 A1 5/2006 Ohshima et al.
2007/0009818 A1 1/2007 Yanagawa et al.
2007/0031746 A1 2/2007 Toshine et al.
2007/0212626 A1 9/2007 Toshine et al.
2007/0212627 A1 9/2007 Yanagawa et al.
2008/0008952 A1* 1/2008 Lim ..... G03G 5/047 430/59.5
2008/0050666 A1* 2/2008 Otsubo ..... G03G 15/751 430/65
2008/0085459 A1 4/2008 Kami et al.
2008/0199217 A1 8/2008 Iwamoto et al.
2008/0304867 A1 12/2008 Nagai et al.
2008/0305426 A1 12/2008 Kurimoto et al.
2010/0209842 A1 8/2010 Yanagawa et al.
2010/0233602 A1 9/2010 Yamamoto et al.
2012/0003577 A1* 1/2012 Katayama ..... G03G 5/047 430/58.05
2012/0051786 A1* 3/2012 Katayama ..... C09D 177/00 399/159
2013/0330104 A1 12/2013 Shimoyama et al.
2015/0316865 A1* 11/2015 Noguchi ..... G03G 5/0542 430/56
2016/0139517 A1 5/2016 Ishida et al.
2016/0161871 A1 6/2016 Asano et al.
2016/0334720 A1 11/2016 Ishida et al.

FOREIGN PATENT DOCUMENTS

JP 2003-084472 3/2003
JP 2003-207912 7/2003
JP 3936774 B2 * 3/2007
JP 2014-199400 10/2014
JP 2014199400 A * 10/2014

OTHER PUBLICATIONS

English language machine translation of JP 2014-199400 (Oct. 2014).*
English language machine translation of JP 08-110648. (Year: 1996).*

* cited by examiner

PHOTOCONDUCTOR, IMAGE FORMING APPARATUS, AND PROCESS CARTRIDGE

CROSS-REFERENCE TO RELATED APPLICATIONS

The present application claims priority under 35 U.S.C. § 119 to Japanese Patent Application No. 2016-087269, filed Apr. 25, 2016. The contents of which are incorporated herein by reference in their entirety.

BACKGROUND OF THE INVENTION

Field of the Invention

The present disclosure relates to a photoconductor, an image forming apparatus including the photoconductor, and a process cartridge including the photoconductor.

Description of the Related Art

In an image forming method using an image forming apparatus, an image is formed by performed steps, such as a charging step, an exposing step, a developing step, and transferring step on a photoconductor (also referred to as an electrophotographic photoconductor, an electrostatic-latent-image-bearing member, or an image bearer). Recently, an organic photoconductor including an organic material is widely used as a photoconductor because of advantages, such as flexibility, thermal stability, and film-forming property.

Recently, there is a need for photoconductors to have greater degrees of durability and stability along with rapid advancement in full-color, high-speed, and high-definition properties of image forming apparatuses. Under such circumstances, abrasion resistance of a photoconductor is drastically improved by improving a surface layer, such as a protective layer. Meanwhile, there is need for each layer constituting the photoconductor (e.g., a charge-generating layer, a charge-transporting layer, an intermediate layer, and an undercoat layer) to have electric durability, chemical durability, and stability of electrical properties to fluctuation of an environment for use.

An organic material constituting a photoconductor gradually changes in quality through electrostatic load in the typical electrographic process including repetitive charging and charge eliminating. As a result, the photoconductor is deteriorated in electrical properties, and cannot retain electric stability when the photoconductor is used over a long period.

Particularly, a titanyl photocyanine pigment used as a charge-generating material in a charge-generating layer has excellent sensitivity properties against light in a region of from a long-wavelength range to a short-wavelength range, but has a problem that generated photo carriers tend to be left behind and a charging performance tends to deteriorate.

Proposed as a technique for improving reduction in charging is a method where an undercoat layer using metal oxide particles, such as zinc oxide, is disposed between a support and a charge-generating layer (see, for example, Japanese Unexamined Patent Application Publication No. 2003-84472 (PTL 1)).

Moreover, an undercoat layer including metal oxide particles and salicylic acid is proposed (see, for example, Japanese Unexamined Patent Application Publication No. 2014-199400 (PTL 2)).

Moreover, a titanyl phthalocyanine pigment has a problem that sensitivity properties largely vary due to fluctuation of the environment (particularly fluctuation of humidity) because sensitivity properties of the titanyl phthalocyanine pigment is obtained when water molecules are incorporated into crystals of titanyl phthalocyanine to function as a sensitizer.

Disclosed as a technique for suppressing a change in sensitivity of titanyl phthalocyanine against fluctuation of humidity is a technique for adding a humectant to a charge-generating layer (see, for example, Japanese Unexamined Patent Application Publication No. 2003-207912 (PTL 3)).

SUMMARY OF THE INVENTION

According to one aspect of the present disclosure, a photoconductor includes a conductive support, an undercoat layer, a charge-generating layer, and a charge-transporting layer. At least the undercoat layer, the charge-generating layer, and the charge-transporting layer are disposed on the conductive support in an order mentioned. The undercoat layer includes a binder resin and metal oxide particles. The charge-generating layer includes a binder resin, a titanyl phthalocyanine pigment, and a salicylic acid derivative.

DESCRIPTION OF THE EMBODIMENTS

Figure 1:
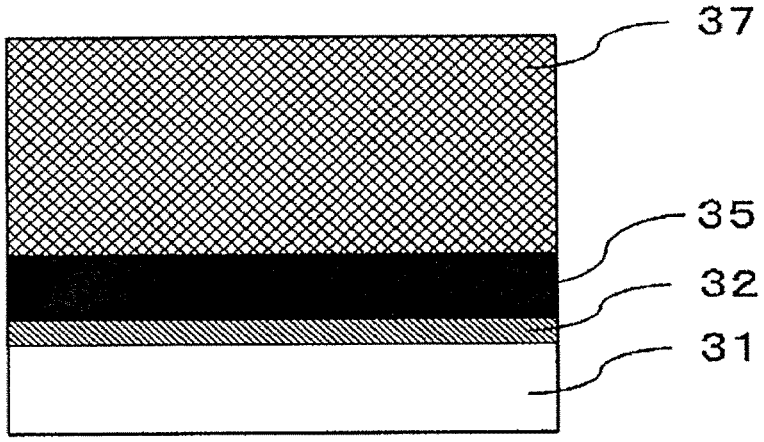
FIG. 1 is a schematic view illustrating one example of a layer configuration of a photoconductor of the present disclosure.

The present disclosure has an object to provide a photoconductor, which can obtain stable electrical properties, even when the photoconductor is used for over a long period or an environment in which the photoconductor is used is fluctuated, and maintain image-quality stability at the time of image formation.

The present disclosure can provide a photoconductor, which can obtain stable electrical properties, even when the photoconductor is used for over a long period or an environment in which the photoconductor is used is fluctuated, and maintain image-quality stability at the time of image formation.

The photoconductors disclosed in PTL 1 to PTL 3 are not satisfactory photoconductors, in view of photoconductors having excellent electric stability, even when the photoconductor is used for over a long period or an environment in which the photoconductor is used is fluctuated, and maintain image-quality stability at the time of image formation, which are the object of the present disclosure.

The present inventors have found that a photoconductor includes a certain undercoat layer and a certain charge-generating layer, where the undercoat layer includes a binder resin and metal oxide particles and the charge-generating layer includes a binder resin, a titanyl phthalocyanine pigment, and a salicylic acid derivative can be a photoconductor having excellent electric stability and image quality stability at a level where the present disclosure aims.

Photoconductor

A photoconductor of the present disclosure includes a conductive support, an undercoat layer, a charge-generating layer, and a charge-transporting layer, at least the undercoat layer, the charge-generating layer, and the charge-transporting layer being disposed on the conductive support in an order mentioned. The photoconductor may further include other layers if necessary.

The undercoat layer include a binder resin and metal oxide particles.

The charge-generating layer includes a binder resin, a titanyl phthalocyanine pigment, and a salicylic acid derivative.

The photoconductor of the present disclosure includes materials specified in the present disclosure in the undercoat layer and the charge-generating layer. The conductive support, the charge-transporting layer, and the above-mentioned other layers can use materials used in the art.

<Undercoat Layer>

The undercoat layer includes metal oxide particles and a binder resin, and may further include other ingredients if necessary.

<<Metal Oxide Particles>>

For example, there are titanium oxide, zinc oxide, tin oxide, and zirconium oxide as the metal oxide particles, but the metal oxide particles are not particularly limited and selected from metal oxide particles that can achieve the object of the present disclosure. Moreover, two or more types of metal oxide particles, each having different properties may be used in combination. The metal oxide particles for use in the present disclosure are preferably zinc oxide because the zinc oxide has excellent electrical properties.

<<<Zinc Oxide Particles>>>

The zinc oxide particles are not particularly limited, and can be selected from zinc oxide particles that can achieve the object of the present disclosure. Moreover, two or more types of zinc oxide particles each having different properties may be used in combination.

—Method for Preparing Zinc Oxide Particles—

The typically known methods are used to produce the zinc oxide particles of the present disclosure, but a so-called wet method is preferably used among them. The wet method is roughly divided into two methods.

One method is as follows: an aqueous solution of a zinc compound (typically, zinc salt) such as zinc sulfate or zinc chloride is neutralized with a solution of soda ash, and the thus-generated zinc carbonate is calcined after washed and dried, to obtain the zinc oxide particles.

The other method is as follows: zinc hydroxide particles are formed, and then are calcined after washed and dried to obtain the zinc oxide particles. In the case of zinc oxide particles obtained by the aforementioned wet methods, an amount of a specific element can be intentionally changed depending on choice of materials and the production conditions to easily obtain the zinc oxide particles of the present disclosure.

Details of the wet method will be described below.

Specifically, the wet method includes producing a precipitate from a zinc-containing aqueous solution and an alkaline aqueous solution, aging and washing the precipitate, wetting the precipitate with an alcohol, starting drying the resultant to obtain a zinc oxide particle precursor, and firing the zinc oxide particle precursor to zinc oxide particles. Here, a zinc compound for preparing the zinc-containing aqueous solution is not particularly limited and examples of the zinc compound include zinc nitrate, zinc chloride, zinc acetate, and zinc sulfate. Zinc sulfate is preferable in order for sulfur derived from sulfuric acid to be contained in the zinc oxide used in the present disclosure.

Examples of the alkaline aqueous solution include aqueous solutions of sodium hydroxide, calcium hydroxide, ammonium hydrogen carbonate, and ammonia. A mixture system of sodium hydroxide, ammonium hydrogen carbonate, and calcium hydroxide is particularly preferable as a method as obtaining the zinc oxide used in the present disclosure.

A concentration of sodium hydroxide in the alkaline aqueous solution is preferably an excess concentration that is a multiple by a value 1.0 time or greater but 1.5 times or less a chemical equivalent needed for the zinc compound to become a hydroxide.

This is because a devoted amount of the zinc compound can react when the alkali is more than or equal to the chemical equivalent and a washing time taken for removing residual alkali is short when the excess concentration is less than or equal to a 1.5-times multiple.

Next, generation and aging of a precipitate will be described.

The precipitate is generated by dropping an aqueous solution of the zinc compound into an alkaline aqueous solution continuously stirred. Immediately upon the aqueous solution of the zinc compound being dropped into the alkaline aqueous solution, a degree of supersaturation is reached to produce a precipitate. Therefore, a precipitate of fine particles of zinc carbonate and zinc carbonate hydroxide having a uniform particle diameter can be obtained.

It is difficult to obtain the precipitate of particles of zinc carbonate and zinc carbonate hydroxide having a uniform particle size as described above by dropping the alkaline solution into the aqueous solution of the zinc compound or by dropping the solution of the zinc compound and the alkaline solution in parallel. A temperature of the alkaline aqueous solution during production of the precipitate is not particularly limited, but is 50° C. or lower, and is preferably room temperature. A lower limit of the temperature of the alkaline aqueous solution is not specified. When a temperature of the alkaline aqueous solution is excessively low, however, a heating device or the like is necessary. Therefore, a temperature at which no such device needs to be used is preferable.

A dropping time for dripping the aqueous solution of the zinc compound into the alkaline aqueous solution is shorter than 30 minutes, preferably 20 minutes or shorter, and further preferably 10 minutes or shorter in terms of productivity. After dropping is completed, stirring is continued for aging in order to homogenize the system internally. An aging temperature is the same as the temperature during production of the precipitate. A time for which stirring is continued is not particularly limited, but is 30 minutes or shorter, and preferably 15 minutes or shorter in terms of productivity.

The precipitate obtained after the aging is washed by decantation. Adjustment of electroconductivity of a washing solution makes it possible to adjust an amount of sulfate ions remaining in the particles. Therefore, an amount of sodium, an amount of calcium, and an amount of sulfate in zinc oxide finally obtained can be controlled.

Next, the washed precipitate is treated by wetting with an alcohol solution and the wetting-treated product is dried to obtain a zinc oxide particle precursor. The wetting treatment can prevent aggregation of the zinc oxide particle precursor obtained after the drying. An alcohol concentration of the alcohol solution is preferably 50% by mass or higher. The alcohol concentration of 50% by mass or higher is preferable because the zinc oxide particles can avoid becoming a strong aggregate and have an excellent dispersibility.

The alcohol solution used in the wetting treatment will be described.

An alcohol used in the alcohol solution is not particularly limited but an alcohol soluble in water and having a boiling point of 100° C. or lower is preferable. Examples of the alcohol include methanol, ethanol, propanol, and tert-butyl alcohol.

The wetting treatment will be described.

The wetting treatment may be performed by putting the filtrated, washed precipitate into the alcohol solution and stirring the precipitate. Here, a time and a stirring speed may be appropriately selected according to the amount treated. The amount of the alcohol solution into which the precipitate is put may be a liquid amount that enables the precipitate to be stirred easily and can secure liquidity. A stirring time and the stirring speed are appropriately selected on the condition that the precipitate that may have been partially aggregated during the filtering and washing described above be uniformly mixed in the alcohol solution until the aggregation is resolved.

The wetting treatment may typically be performed at normal temperature. However, as needed, the wetting treatment may also be performed while performing heating to a degree until which the alcohol does not evaporate and get lost. It is preferable to perform heating at a temperature lower than or equal to the boiling point of the alcohol. This makes it possible to avoid the alcohol dissipating during the wetting treatment and the wetting treatment being ineffective. Persistence of the presence of the alcohol during the wetting treatment is preferable because the effect of the wetting treatment can be obtained and the precipitate does not become a strong aggregate after dried.

The method for drying the wetting-treated product will be described.

Drying conditions such as a drying temperature and a time are not particularly limited and heating drying may be started in the state that the wetting-treated product is wet with the alcohol. The precipitate does not become a strong aggregate even when heating-dried so long as the heating drying is performed after the wetting treatment. Therefore, drying conditions may be appropriately selected depending on the amount of the wetting-treated product treated, a treating apparatus, etc.

Through the drying treatment, a zinc oxide particle precursor that has undergone the wetting treatment can be obtained. The precursor is fired to become zinc oxide particles. The firing of the zinc oxide precursor that has undergone the drying treatment is performed under an atmosphere of an inert gas such as atmospheric air, nitrogen, argon, and helium or an atmosphere of a mixed gas between the inert gas described above and a reducing gas such as hydrogen. Here, a lower limit of a treating temperature is preferably around 400° C. in terms of a desired ultraviolet absorbing (shielding) property. A treating time is appropriately selected depending on the amount of the zinc oxide precursor treated and a firing temperature.

<<<Average Particle Diameter of Metal Oxide Particles>>>

A particle size (volume average particle diameter) of the metal oxide particles can be appropriately selected depending on the intended purpose, but an average particle diameter is 20 nm or greater but 200 nm or less, more preferably 50 nm or greater but 150 nm or less. When the average particle diameter is 20 nm or greater, an undercoat layer having an excellent dispersibility can be formed. When the average particle diameter is 200 nm or less, excellent electrical properties of the undercoat layer can be maintained.

An average primary particle diameter of the metal oxide particles can be determined in the following manner. Arbitrary one hundred particles in the undercoat layer are observed using a transmission electron microscope (TEM), a projected area of each of the particles is determined, and a circle equivalent diameter of the obtained area is calculated. A volume average particle diameter is determined from the calculated circle equivalent diameters, and the obtained average value is determined as an average particle diameter.

<<Binder Resin>>

The binder resin included in the undercoat layer is not particularly limited and may be appropriately selected depending on the intended purpose. Examples of the binder resin include: water-soluble resins (e.g., polyvinyl alcohol, casein, and sodium polyacrylate); alcohol soluble resins (e.g., copolymer nylon and methoxymethylated nylon); and curable resins which form three-dimensional network structures (e.g., polyurethane, a melamine resin, a phenol resin, an alkyd-melamine resin, and an epoxy resin).

Among the above-listed binder resins, resins having high resistance to typical organic solvents are preferable considering that a photoconductive layer (a combination of the charge-generating layer and the charge-transporting layer may be referred to as a photoconductive layer) is applied on the resin using a solvent.

<<Salicylic Acid Derivative>>

In addition to the binder resin and the metal oxide particles, the under layer preferably includes a salicylic acid derivative for use in a charge-generating layer.

The salicylic acid derivative is specifically described in a column of <<Salicylic acid derivative>> in <Charge-generating layer> below.

It is assumed that electrons are easily taken into the undercoat layer from the charge-generating layer because the salicylic acid derivative is used in the undercoat layer, and accumulation of electrons at an interface between the photoconductive layer and the undercoat layer can be prevented.

Moreover, it is assumed that the salicylic acid derivative can enhance dispersibility of the metal oxide particles. Since the metal oxide particles typically have low affinity to an organic solvent or a binder resin, aggregations of the metal oxide particles tend to occur. Therefore, it is difficult to maintain electrical properties of a film over a long period. Use of the salicylic acid derivative can enhance affinity between the metal oxide particles and an organic solvent, a binder resin, etc. As a result, dispersibility of the metal oxide particles can be enhanced.

<<<Amount of Salicylic Acid Derivative>>

An amount of the salicylic acid derivative in the undercoat layer is appropriately from 0.01 parts by mass through 10 parts by mass, preferably from 0.1 parts by mass through 5 parts by mass, relative to 100 parts by mass of the metal oxide particles. When the amount of the salicylic acid derivative is too small, dispersibility of the metal oxide particles may not be sufficiently enhanced. When the amount of the salicylic acid derivative is too large, electrical properties of a resultant film may be impaired.

<<Other Ingredients>>

The undercoat layer may include other ingredients to improve electrical properties, environmental stability, and image quality.

The above-mentioned other ingredients are not particularly limited and may be appropriately selected depending on the intended purpose. Examples of the above-mentioned other ingredients include: electron-transporting materials; electron-transporting pigments, such as fused polycyclic pigments and azo-pigments; silane-coupling agents; zirconium chelating compounds; titanium chelating compounds; aluminium chelating compounds; fluorenone compounds; titanium alkoxide compounds; organic titanium compounds; and antioxidants, plasticizers, lubricants, ultraviolet absorbing agents, and leveling agents, which are described later. The above-listed ingredients may be used alone or in combination.

A method for dispersing the metal oxide particles in an undercoat-layer coating liquid is not particularly limited and may be appropriately selected depending on the intended purpose. Examples of the method include a dispersing method using a ball-mill, a sand-mill, a vibrating-mill, a three-roll mill, an attriter, a pressure homogenizer, or ultrasonic dispersion.

The coating method is not particularly, and may be appropriately selected depending on a viscosity of a coating liquid, and a desired film thickness of an undercoat layer. Examples of the coating method include dip coating, spray coating, bead coating, and ring coating.

After applying the undercoat-layer coating liquid through coating, the applied liquid may be heated and dried by an oven etc., if necessary. A temperature for drying the undercoat layer is not particularly limited, and may be appropriately selected depending on types of a solvent included in the undercoat-layer coating liquid. The temperature is preferably 80° C. or higher but 200° C. or lower, and more preferably 100° C. or higher but 150° C. or lower.

<<Average Film Thickness of Undercoat Layer>>

An average film thickness of the undercoat layer is not particularly limited and may be appropriately selected depending on electrical properties or service life of a photoconductor to be produced. The average film thickness is preferably 7 μm or greater but 30 μm or less, and more preferably 10 μm or greater but 25 μm or less.

When the average film thickness is 7 μm or greater, a following problem is prevented. Specifically, the problem is that image defects in the state of background smearing occurs due to charging failures, because charge having reverse polarity to charging polarity of a surface of a photoconductor is flown from a conductive support into a photoconductive layer. When the average film thickness is 30 μm or less, defects, such as degradation of an optical attenuating function, such as a rise of a residual potential, and degradation of repeating stability, do not occur. As a method for measuring an average film thickness of the undercoat layer, for example, an eddy-current film thickness meter, a contact thickness meter, a scanning electron microscope, or a transmission electron microscope can be used. As a calculation method of an average film thickness of the undercoat layer, a thickness of the undercoat layer is measured at randomly-selected five points and an average value is determined from the measured five values.

<Charge-Generating Layer>

A charge-generating layer is disposed on the undercoat layer.

The charge-generating layer includes a binder resin, a titanyl phthalocyanine pigment, and a salicylic acid derivative, and may further include other ingredients if necessary.

As described above, a titanyl phthalocyanine pigment has excellent sensitivity properties, but has problems in charging ability and environmental stability. The present inventors have found that excellent charging ability and environmental stability can be achieved by adding a salicylic acid derivative to the same layer which includes a titanyl phthalocyanine pigment.

<<Titanyl Phthalocyanine Pigment>>

A basic structure of a titanyl phthalocyanine pigment (TiOPc) is represented by General Formula (1) below.

General Formula (1)

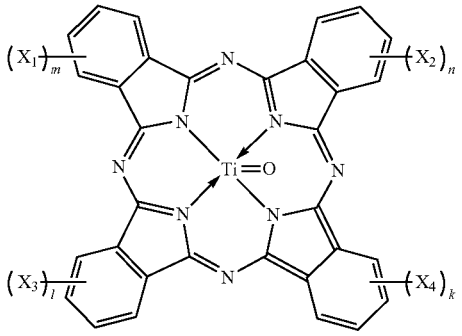

In General Formula (1), $X_1$, $X_2$, $X_3$, and $X_4$ are each independently any of various halogen atoms, and n, m, l, and k are each independently a number of 0 through 4).

Examples of literatures related to synthesis methods or electrophotographic properties of titanyl phthalocyanine include Japanese Unexamined Patent Application Publication Nos. 57-148745, 59-36254, 59-44054, 59-31965, 61-239248, and 62-67094. Moreover, various crystal systems of titanyl phthalocyanine have been known. Titanyl phthalocyanines having different crystal shapes are disclosed in Japanese Unexamined Patent Application Publication Nos. 59-49544, 59-166959, 61-239248, 62-67094, 63-366, 63-116158, 63-196067, and 64-17066.

Among the above-mentioned titanyl phthalocyanine pigments, in the present disclosure, a particularly preferable titanyl phthalocyanine pigment is a titanyl phthalocyanine pigment, which is obtained by using, as a raw material, a titanyl phthalocyanine crystal (precursor), which has a maximum diffraction peak at least at 27.2° as a diffraction peak (±0.2°) of Bragg angle 2θ relative to CuKα X-rays (wavelength: 1.542 angstroms), further has main peaks at 9.4°, 9.6°, and 24.0°, has, as a diffraction peak at the lowest angle side, a peak at 7.3°, does not have a peak between the peak at 7.3° and the peak at 9.4°, and moreover does not have a peak at 26.3°, and performing crystal transition (crystal transformation process) on the precursor.

<<Binder Resin>>

The binder resin included in the charge-generating layer is not particularly limited and may be appropriately selected depending on the intended purpose. Examples of the binder resin include polyamide resins, polyurethane resins, epoxy resins, polyketone resins, polycarbonate resins, silicone resins, acrylic resins, polyvinyl butyral resins, polyvinylformal resins, polyvinylketone resins, polystyrene resins, poly-N-vinylcarbazole resins, and polyacrylamide resins. The above-listed binder resins may be used alone or in combination.

In addition to the above-mentioned binder resins, the binder resin may include a charge-transporting polymer material having a charge-transporting function. Examples of the charge-transporting polymer material include polymer materials (e.g. polycarbonate, polyester, polyurethane, polyether, polysiloxane, and acrylic resins) having an arylamine skeleton, a benzidine skeleton, a hydrazone skeleton, a carbazole skeleton, a stilbene skeleton, and a pyrazolines skeleton, and polymer materials having a polysilane skeleton.

<<Salicylic Acid Derivative>>

Examples of the salicylic acid derivative include salicylic acid, acetylsalicylic acid, 5-acetylsalicylic acid, 3-aminosalicylic acid, 5-acetylsalicylamide, 5 aminosalicylic acid, 4-azidesalicylic acid, benzyl salicylate, 4-tert-butylphenyl salicylate, butyl salicylate, 2-carboxyphenyl salicylate, 3,5-dinitrolsalicylic acid, dithiosalicylic acid, ethyl acetylsalicylate, 2-ethylhexyl salicylate, ethyl 6-methylsalicylate, ethyl salicylate, 5-formylsalicylic acid, 4-(2-hydroxyethoxy)salicylic acid, 2-hydroxyethyl salicylate, isoamyl salicylate, isobutyl salicylate, isopropyl salicylate, 3-methoxysalicylic acid, 4-methoxysalicylic acid, 6-methoxysalicylic acid methyl acetylsalicylate, methyl 5-acetylsalicylate, methyl 5-allyl-3-methoxysalicylate, methyl 5-formylsalicylate, methyl 4-(2-hydroxyethoxy)salicylate, methyl 3-methoxysalicylate, methyl 4-methoxysalicylate, methyl 5-methoxysalicylate, methyl 4-methylsalicylate, methyl 5-methylsalicylate, methyl salicylate, 3-methylsalicylic acid, 4 methylsalicylic acid, 5-methylsalicylic acid, methyl thiosalicylate, 4-nitrophenyl, 5 nitrosalicylic acid, 4-nitrosalicylic acid, 3-nitrosalicylic acid, 4-octylphenyl salicylate, phenyl salicylate, 3-acetoxy-2-naphthanilide, 6-acetoxy-2-naphthoic acid, 3-amino-2-naphthoic acid, 6-amino-2-naphthoic acid, 1,4-dihydroxy-2-naphthoic acid, 3,5-dihydroxy-2-naphthoic acid, 3,7-dihydroxy-2-naphthoic acid, 2-ethoxy-1-naphthoic acid, 2-hydroxy-1-(2-hydroxy-4-sulfo-1-naphthylazo)-3-naphthoic acid, 3-hydroxy-7-methoxy-2-naphthoic acid, 1-hydroxy-2-naphthoic acid, 2-hydroxy-1-naphthoic acid, 3-hydroxy-2-naphthoic acid, 6-hydroxy-1-naphthoic acid, 6-hydroxy-2-naphthoic acid, 3-hydroxy-2-naphthoic acid hydrazide, 2-methoxy-1-naphthoic acid, 3-methoxy-2-naphthoic acid, 6-methoxy-2-naphthoic acid, methyl 6-amino-2-naphthoate, methyl 3-hydroxy-2-naphthoate, methyl 6-hydroxy-2-naphthoate, methyl 3-methoxy-2 naphthoate, phenyl 1,4-dihydroxy-2-naphthoate, and phenyl 1-hydroxy-2-naphthoate. The above-listed examples may be used alone or in combination as a mixture of two or more derivatives.

<<<Amount of Salicylic Acid Derivative>>>

An amount of the salicylic acid derivative is preferably 0.01% by mass or greater but 3% by mass or less, more preferably 0.1% by mass or greater but 1.5% by mass or less, relative to the titanyl phthalocyanine pigment. When the amount of the salicylic acid derivative relative to the titanyl phthalocyanine pigment is 0.01% by mass or greater, an effect the salicylic acid derivative gives can be efficiently exhibited, and excellent properties can be obtained. When the amount of the salicylic acid derivative relative to the titanyl phthalocyanine pigment is 3% by mass or less, moreover, the salicylic acid derivative does not inhibit generation of charges of the titanyl phthalocyanine pigment, and excellent properties can be obtained. The above-listed salicylic acid derivatives may be used alone or in combination.

<<Other Ingredients>>

The above-mentioned other ingredients included in the charge-generating layer are not particularly limited and may be appropriately selected depending on the intended purpose. Examples of the above-mentioned other ingredients include low-molecular-weight charge-transporting materials, solvents, antioxidants, plasticizers, lubricants, ultraviolet absorbing agents, and leveling agents, where the antioxidants, the plasticizers, the lubricants, the ultraviolet absorbing agents, and the leveling agents will be described hereinafter.

An amount of the other components is not particularly limited and may be appropriately selected depending on the intended purpose, but it is preferably in a range of from 0.01% by mass through 10% by mass relative to the total mass of the coating liquid for charge generating layer.

<<<Low-Molecular-Weight Charge-Transporting Material>>>

The low-molecular-weight charge-transporting material is not particularly limited and may be appropriately selected depending on the intended purpose. Examples of the low-molecular-weight charge-transporting material include electron-transporting materials and hole-transporting materials.

The electron-transporting materials are not particularly limited and may be appropriately selected depending on the intended purpose. Examples of the electron-transporting materials include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, 1,3,7-trinitrodibenzothiophene-5,5-dioxide, and diphenoquinone derivatives. The above-listed materials may be used alone or in combination.

The hole-transporting materials are not particularly limited and may be appropriately selected depending on the intended purpose. Examples of the hole-transporting materials include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazolines derivatives, divinylbenzene derivatives, hydrazone derivatives, indene derivatives, butadiene derivatives, pyrene derivatives, bis-stilbene derivatives, and enamine derivatives. The above-listed materials may be used alone or in combination.

<<<Solvent>>>

The solvent is not particularly limited and may be appropriately selected depending on the intended purpose. Examples of the solvent include tetrahydrofuran, dioxane, dioxolane, toluene, dichloromethane, monochlorobenzene, dichloroethane, cyclohexanone, cyclopentanone, anisole, xylene, methylethylketone, acetone, ethyl acetate, and butyl acetate. The above-listed solvents may be used alone or in combination.

<<Method for Forming Charge-Generating Layer>>

A method for forming the charge-generating layer is not particularly limited and may be appropriately selected depending on the intended purpose. Examples of the method include a method in which the charge-generating material and the binder resin are dissolved or dispersed in other components such as the solvent to obtain a coating liquid; and the coating liquid is coated on the conductive support, followed by drying, to obtain the charge-generating layer. Note that, an identical method to the dispersion method of the undercoat layer coating liquid can be used for the dispersing, and the coating liquid can be applied by dip coating, spray coating, ring coating, or casting.

A thickness of the charge-generating layer is not particularly limited and may be appropriately selected depending on the intended purpose. The thickness of the charge-generating layer is preferably from 0.01 μm through 5 μm and more preferably from 0.05 μm through 2 μm.

<Charge-Transporting Layer>

The charge-transporting layer is a layer that retains charges, and transfers charges generated and separated through exposure in the charge-generating layer to be combined with the retained charges. In order to achieve the object of retaining the charges, the charge-transporting layer is required to have high electric resistance. In order that the retained charges obtain high surface potential, the charge-transporting layer is required to have low permittivity and good electric charge mobility.

The charge-transporting layer includes a charge-transporting material, preferably includes a binder resin, and further includes other ingredients according to the necessary.

<<Charge-Transporting Material>>

The charge-transporting material is not particularly limited and may be appropriately selected depending on the intended purpose. Examples of the charge-transporting material include electron-transporting materials, hole-transporting materials, and polymer charge-transporting materials.

An amount of the charge-transporting material relative to a total amount of the charge-transporting layer is not particularly limited and may be appropriately selected depending on the intended purpose. The amount of the charge-transporting material is preferably from 20% by mass through 90% by mass and more preferably from 30% by mass through 70% by mass. When the amount is 20% by mass or greater, a problem that desired optical attenuating properties cannot be obtained because of low charge-transporting properties of the charge-transporting layer can be prevented effectively. When the amount is 90% by mass or less, a problem that the photoconductor is worn more than necessary due to various hazards the photoconductor receives from an image forming step can be effectively prevented. Meanwhile, the amount of the charge-transporting material in the charge-transporting layer in the more preferable range is advantageous in that desired optical attenuating property may be obtained, and an electrophotographic photoconductor low in wear through uses can be obtained.

<<<Electron-Transporting Materials>>>

The electron-transporting materials (electron-accepting materials) are not particularly limited and may be appropriately selected depending on the intended purpose. Examples of the electron-transporting materials include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. The above-listed materials may be used alone or in combination.

<<<Hole-Transporting Materials>>>

The hole-transporting materials (electron-donating materials) are not particularly limited and may be appropriately selected depending on the intended purpose. Examples of the hole-transporting materials include oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. The above-listed materials may be used alone or in combination.

<<<Polymer Charge-Transporting Materials>>>

The polymer charge-transporting material is a material having both of the function of the charge-transporting material and the function of the binder resin, which will be described hereinafter.

The polymer charge-transporting materials are not particularly limited and may be appropriately selected depending on the intended purpose. Examples of the polymer charge-transporting materials include polymers containing a carbazole ring, polymers containing a hydrazone structure, polysilylene polymers, polymers containing a triarylamine structure (e.g., polymers containing a triarylamine structure disclosed in Japanese Patent No. 3852812 and Japanese Patent No. 3990499), polymers containing an electron donating group, and other polymers. The above-listed materials may be used alone or in combination. The polymer charge-transporting material may be used in combination with a below-described binder resin in terms of abrasion resistance and film-forming properties.

An amount of the polymer charge-transporting material relative to total mass of the charge-transporting layer is not particularly limited and may be appropriately selected depending on the intended purpose. In the case where the polymer charge-transporting material is used in combination with the below-described binder resin, the amount is preferably from 40% by mass through 90% by mass, and more preferably from 50% by mass through 80% by mass.

<<Binder Resin>>

The binder resin included in the charge-transporting layer is not particularly limited and may be appropriately selected depending on the intended purpose. Examples of the binder resin include polycarbonate resins, polyester resins, methacryl resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinylcarbazole resins, polyvinyl butyral resins, polyvinylformal resins, polyacrylate resins, polyacrylamide resins, and phenoxy resins. The above-listed binder resins may be used alone or in combination.

The charge-transporting layer may include a copolymer of a cross-linking binder resin and a cross-linking charge-transporting material.

<<Other Ingredients>>

The above-mentioned other ingredients included in the charge-transporting layer are not particularly limited and may be appropriately selected depending on the intended purpose. Examples of the above-mentioned other ingredients include a solvent, an antioxidant, a plasticizer, a lubricant, an ultraviolet absorbing agent, and a leveling agent, where the antioxidant, the plasticizer, the lubricant, the ultraviolet absorbing agent, and the leveling agent will be described hereinafter.

An amount of the above-mentioned other ingredients is not particularly limited and may be appropriately selected depending on the intended purpose. The amount is preferably from 0.01% by mass through 10% by mass relative to a total mass of the layer to which the above-mentioned other ingredients are added.

<<<Solvent>>>

The solvent is not particularly limited and may be appropriately selected depending on the intended purpose. The solvent can be the same solvent as used in the preparation of the charge-generating layer. However, a solvent that can favorably dissolve the charge-generating layer and the binder resin is preferable. Such solvents may be used alone or in combination as a mixture.

<<Method for Forming Charge-Transporting Layer>>

A method for forming the charge-transporting layer is not particularly limited and may be appropriately selected depending on the intended purpose. Examples of the method include a method in which a coating liquid is coated on a charge-generating layer, which is heated and dried to form a charge-transporting layer, where the coating liquid is obtained by dissolving or dispersing the charge-transporting material and the binder resin in the other components (e.g., a solvent).

A method for coating the coating liquid used during formation of the charge-transporting layer is not particularly limited and may be appropriately selected depending on properties such as viscosity of the coating liquid and a thickness of the charge-transporting layer desired. Examples of the method include dip coating, spray coating, bead coating, and ring coating.

The solvent needs to be removed from the charge-transporting layer by heating the charge-transporting layer using any unit in view of electrophotographic properties and viscosity of the film.

Examples of the method for heating the charge-transporting layer include a method in which air, gas (e.g., nitrogen), vapor, or heat energy (e.g., various heating media, infrared rays, and electromagnetic rays) is used to heat the charge-transporting layer from a side of the coated surface or a side of the conductive support.

A temperature at which the charge-transporting layer is heated is not particularly limited and may be appropriately selected depending on the intended purpose. The temperature is preferably from 100° C. through 170° C. When the temperature is 100° C. or higher, the organic solvent in the film can be sufficiently removed, hence deteriorations in electrophotographic properties and abrasion resistance can be effectively prevented. When the temperature is 170° C. or lower, on the other hand, generations of lime-peel-like defects or cracks on a surface of the film and peeling of the charge-transporting layer from an adjacent layer can be effectively prevented. Therefore, desired electrical properties can be obtained even when volatile ingredients in a photoconductive layer are dispersed outside.

A thickness of the charge-transporting layer is not particularly limited and may be appropriately selected depending on the intended purpose. The thickness is preferably 50 μm or less, more preferably 45 μm or less in terms of resolution and responsiveness. A lower limit of the thickness varies depending on a system to be used (particularly, charge electric potential and the like), but the lower limit is preferably 5 μm or more.

<Other Layers>

The above-mentioned other layers are not particularly limited and may be appropriately selected depending on the intended purpose. Examples of the above-mentioned other layers include a protective layer, an intermediate layer, and a second undercoat layer.

<<Protective Layer>>

The protective layer (hereinafter may be referred to as surface layer) can be disposed on a photoconductive layer in order to improve the photoconductor in durability and other functions. The protective layer includes a binder resin and fillers, and further includes other ingredients according to the necessary.

<<<Binder Resin>>>

The binder resin included in the above-mentioned other layers is not particularly limited and may be appropriately selected depending on the intended purpose. Examples of the binder resin include AS resins, ABS resins, ACS resins, olefin-vinyl monomer copolymers, chlorinated polyether resins, allyl resins, phenol resins, polyacetal resins, polyamide resins, polyamide imide resins, polyacrylate resins, polyarylsulfone resins, polybutylene resins, polybutylene terephthalate resins, polycarbonate resins, polyethersulfone resins, polyethylene resins, polyethylene terephthalate resins, polyimide resins, acrylic resins, polymethyl pentene resins, polypropylene resins, polyphenylene oxide resins, polysulfone resins, polyurethane resins, polyvinyl chloride resins, polyvinylidene chloride resins, and epoxy resins. The above-listed binder resins may be used alone or in combination. Among the above-listed binder resins, polycarbonate resins and polyacrylate resins are preferable in terms of dispersibility of the fillers, and reduction in residual potential and film defect.

<<Fillers>>

The fillers are not particularly limited and may be appropriately selected depending on the intended purpose. Examples of the fillers include metal oxide particles.

The metal oxide particles are not particularly limited and may be appropriately selected depending on the intended purpose. Examples of the metal oxide particles include aluminium oxide, zinc oxide, titanium oxide, tin oxide, antimony oxide, indium oxide, bismuth oxide, tin-containing indium oxide, tin oxide containing antimony or tantalum, and antimony-containing zirconium oxide. The above-listed materials may be used alone or in combination.

A method for forming the protective layer is not particularly limited, and an appropriate solvent and appropriate coating method are used to form the protective layer as described in the formation of the above-described photoconductive layer (the charge-generating layer and the charge-transporting layer). Examples of the coating method include dip coating, spray coating, bead coating, nozzle coating, spinner coating, and ring coating. A solvent used in the method for forming the protective layer is not particularly limited and may be appropriately selected depending on the intended purpose. Examples of the solvent include tetrahydrofuran, dioxane, toluene, dichloromethane, monochlorobenzene, dichloroethane, cyclohexanone, methyl ethyl ketone, and acetone.

The solvent is preferably high in viscosity during dispersion of the binder resin and the fillers, and that solvent be high in volatility during the coating. When there is no solvent satisfying the aforementioned properties, two or more solvents having the aforementioned properties can be mixed for use, which may result in a large effect on residual potential and dispersibility of the fillers.

It is effective and useful that the charge-transporting material as described for the charge-transporting layer is added to the protective layer in terms of reduction in residual potential and improvement in image quality.

A thickness of the protective layer is not particularly limited and may be appropriately selected depending on the intended purpose. The thickness is preferably from 1 μm through 5 μm in view of abrasion resistance.

<<Intermediate Layer>>

The intermediate layer can be disposed between the charge-transporting layer and the surface layer in order to prevent the surface layer from contamination of the components of the charge-transporting layer, or in order to improve adhesiveness between the charge-transporting layer and the surface layer. The intermediate layer includes a binder resin, and may further include other ingredients, such as an antioxidant, which will be described hereinafter, if necessary. The intermediate layer is preferably insoluble or poorly soluble in the coating liquid for surface layer.

The binder resin included in the intermediate layer is not particularly limited and may be appropriately selected depending on the intended purpose. Examples of the binder resin include polyamide, alcohol-soluble nylon, polyvinyl butyral, and polyvinyl alcohol.

A method for forming the intermediate layer is not particularly limited and may be appropriately selected depending on the intended purpose. Examples of the method for forming the intermediate layer include a method where an intermediate layer is formed using an appropriate solvent and an appropriate solvent, which are identical or similar to the solvent and coating method used in the formation of the charge-generating layer or the formation of the charge-transporting layer.

A thickness of the intermediate layer is not particularly limited and may be appropriately selected depending on the intended purpose. The thickness is preferably from 0.05 μm through 2 μm.

<<Second Undercoat Layer>>

In the photoconductor, the second undercoat layer can be disposed between the conductive support and the undercoat layer, or between the undercoat layer and the photoconductive layer. The second undercoat layer includes a binder resin, and may further include other ingredients if necessary.

The binder resin is not particularly limited and may be appropriately selected depending on the intended purpose. Examples of the binder resin include polyamide, an alcohol-soluble nylon, a water-soluble polyvinyl butyral, polyvinyl butyral, and polyvinyl alcohol.

A method for forming the second undercoat layer is not particularly limited. The second undercoat layer can be formed using an appropriate solvent and an appropriate coating method.

A thickness of the second undercoat layer is not particularly limited and may be appropriately selected depending on the intended purpose. The thickness is preferably from 0.05 μm through 2 μm.

In order to improve the photoconductor of the present disclosure in resistance to environment, particularly to prevent the photoconductor of the present disclosure from deteriorating in sensitivity and raising residual potential, an antioxidant, a plasticizer, a lubricant, an ultraviolet absorbing agent, and a leveling agent can be added as the other ingredients to each of the layers (e.g., the charge-generating layer, the charge-transporting layer, the undercoat layer, the protective layer, and the second undercoat layer).

The antioxidant is not particularly limited and may be appropriately selected depending on the intended purpose. Examples of the antioxidant include phenol compounds, paraphenylene diamines, hydroquinones, organic sulfur compounds, and organic phosphorus compounds. The above-listed examples may be used alone or in combination as a mixture.

The plasticizer is not particularly limited and may be appropriately selected depending on the intended purpose. Examples of the plasticizer include plasticizers of the general resins such as dibutyl phthalate and dioctyl phthalate.

The lubricant is not particularly limited and may be appropriately selected depending on the intended purpose. Examples of the lubricant include hydrocarbon compounds, fatty acid compounds, fatty acid amide compounds, ester compounds, alcohol compounds, metal soaps, natural waxes, and other lubricants. The above-listed examples may be used alone or in combination as a mixture.

The ultraviolet absorbing agent is not particularly limited and may be appropriately selected depending on the intended purpose. Examples of the ultraviolet absorbing agent include benzophenone ultraviolet absorbing agents, salicylate ultraviolet absorbing agents, benzotriazole ultraviolet absorbing agents, cyanoacrylate ultraviolet absorbing agents, quenchers (metal complex salt ultraviolet absorbing agents), and HALS (hindered amines stabilizer). The above-listed examples may be used alone or in combination as a mixture.

The leveling agent is not particularly limited and may be appropriately selected depending on the intended purpose. Examples of the leveling agent include silicone oils such as dimethyl silicone oils and methylphenyl silicone oils; and polymers or oligomers containing a perfluoroalkyl group at a side chain. The above-listed examples may be used alone or in combination.

<Conductive Support>

The conductive support is not particularly limited and may be appropriately selected depending on the intended purpose, so long as volume resistivity of the conductive support is $1\times10^{10}$ Ω·cm or less. Note that, the endless belts (e.g., endless nickel belt, and endless stainless belt) may be used.

A method for forming the conductive support is not particularly limited and may be appropriately selected depending on the intended purpose. The conductive support is formed, by for example, coating a support (e.g., a film-like or cylindrical plastic or paper) with a metal (e.g., aluminium, nickel, chromium, nichrome, copper, gold, silver, and platinum) or a metal oxide (e.g., tin oxide and indium oxide) through sputtering or vapor deposition. Moreover, a plate of metal (e.g., aluminium, alloy of aluminium, nickel, and stainless) can be extruded or drawn out, followed by surface treatment (e.g., after forming an original tube, cutting, super-finishing, and polishing) to form the conductive support.

A method for forming the conductive layer is not particularly limited and may be appropriately selected depending on the intended purpose. For example, the conductive layer can be formed by coating the conductive support with a coating liquid, where the coating liquid is obtained by dispersing or dissolving conductive powder and a binder resin in a solvent if necessary. Moreover, the conductive layer can be formed by using a thermal shrinkage tube containing the conductive powder in materials (e.g., polyvinyl chloride, polypropylene, polyester, polystyrene, polyvinylidene chloride, polyethylene, chlorinated rubbers, and TEFLON (Registered Trademark)).

The conductive powder is not particularly limited and may be appropriately selected depending on the intended purpose. Examples of the conductive powder include: carbon fine particles (e.g., carbon black and acetylene black); metal powder (e.g., aluminium, nickel, iron, nichrome, copper, zinc, and silver); and metal oxide powder (e.g., conductive tin oxide and ITO).

A binder resin used in the conductive layer is not particularly limited and may be appropriately selected depending on the intended purpose. Examples of the binder resin include thermoplastic resins, thermosetting resins, and photocurable resins. Specific examples of the binder resin include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyallylate resins, phenoxy resins, polycarbonate resins, cellulose acetate resins, ethyl cellulose resins, polyvinyl butyral resins, polyvinylformal resins, polyvinyl toluene resins, poly-N-vinylcarbazole, acrylic resins, silicone resins, epoxy resins, melamine resins, urethane resins, phenol resins, and alkyd resins.

A solvent used in the conductive layer is not particularly limited and may be appropriately selected depending on the intended purpose. Examples of the solvent include tetrahydrofuran, dichloromethane, methylethylketone, and toluene.

Embodiments of Photoconductor

Embodiments of the photoconductor of the present disclosure will be described hereinafter.

First Embodiment

A layer configuration of the photoconductor according to a first embodiment will be described with reference to FIG. 1.

FIG. 1 illustrates a structure including a laminate photoconductive layer, and illustrates a layer configuration of the photoconductor where an undercoat layer 32, a charge-generating layer 35, and a charge-transporting layer 37 are sequentially disposed on a conductive support 31. Note that, a combination of the charge-generating layer 35 and the charge-transporting layer 37 corresponds to a photoconductive layer.

Second Embodiment

A layer configuration of the photoconductor according to a second embodiment will be described with reference to FIG. 2.

Figure 2:
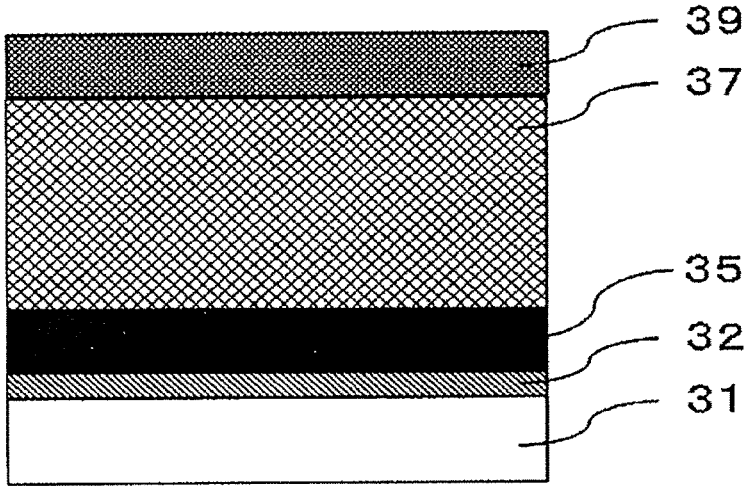
FIG. 2 is a schematic view illustrating one example of a layer configuration of the photoconductor of the present disclosure.

FIG. 2 illustrates a structure including a laminate photoconductive layer, and illustrates a layer configuration of the photoconductor where an undercoat layer 32, a charge-generating layer 35, a charge-transporting layer 37, and a protective layer 39 are sequentially disposed on a conductive support 31. Note that, a combination of the charge-generating layer 35 and the charge-transporting layer 37 corresponds to a photoconductive layer.

(Image Forming Apparatus)

An image forming apparatus of the present disclosure includes at least a photoconductor, a charging unit configured to charge a surface of the photoconductor, an exposing unit configured to expose the surface charged of the photoconductor to light to form an electrostatic latent image, a developing unit configured to develop the electrostatic latent image with a toner to form a visible image, and a transferring unit configured to transfer the visible image onto a recording medium. The image forming apparatus may further include other units if necessary.

The photoconductor used in the image forming apparatus is the above-described photoconductor of the present disclosure. Note that, the charging unit and the exposing unit may be collectively referred to as an electrostatic-latent-image-forming unit.

Embodiment of Image Forming Apparatus

Hereinafter, one embodiment of the image forming apparatus of the present disclosure will be described with reference to the following example.

Figure 3:
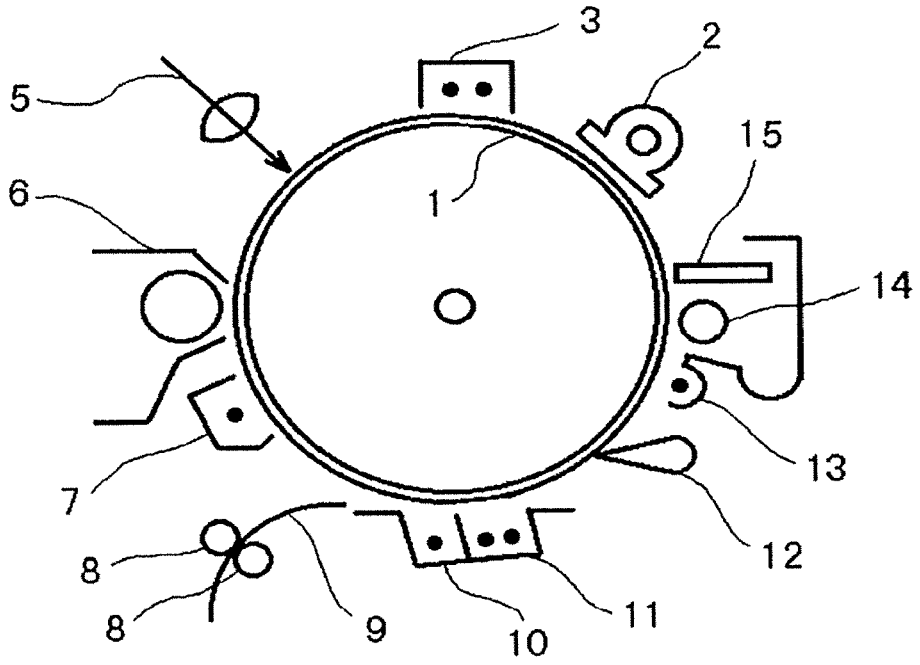
FIG. 3 is a schematic view illustrating one example of an image forming apparatus of the present disclosure.

FIG. 3 is a schematic view illustrating an image forming apparatus of the present disclosure. A charging unit 3, an exposing unit 5, a developing unit 6, and a transfer unit 10 are disposed around a photoconductor 1. First, the charging unit 3 uniformly charges the photoconductor 1. As the charging unit 3, for example, a scorotron device, a scorotron device, a solid-state discharging element, a multi-stylus electrode, a roller charging device, and a conductive brush device are used, and typically known systems can be used.

Next, an electrostatic latent image is formed on the uniformly charged photoconductor 1 by the exposing unit 5. Examples of a light source used in the exposing unit include general luminescent products such as a fluorescent lamp, a tungsten lamp, a halogen lamp, a mercury lamp, a sodium-vapor lamp, a light-emitting diode (LED), a laser diode (LD), and electroluminescence (EL). In order to emit light having a predetermined wavelength, various filters such as a sharp cut filter, a band pass filter, a near infrared cut filter, a dichroic filter, an interference filter, and a color conversion filter can be used.

Then, the electrostatic latent image formed on the photoconductor 1 is visualized by the developing unit 6. Examples of a developing system used include a one-component development method using a dry toner, a two-component development method, and a wet developing method using a wet toner. The photoconductor 1 is subjected to positive (negative) charging, and then is imagewise exposed to light to form a positively (negatively)-charged electrostatic latent image on the surface of the photoconductor. This electrostatic latent image is developed with a toner (voltage-detecting particles) having negative (positive) polarity to obtain a positive image. Moreover, the latent image is developed with a toner having positive (negative) polarity to obtain a negative image.

Next, the toner image visualized on the photoconductor 1 is transferred onto a recording medium 9 by the transfer unit 10. Moreover, in order for the toner image to be favorably transferred, a pre-transfer charger 7 may be used. As the transfer unit 10, an electrostatic transfer system using a transfer charger or a bias roller; a mechanical transfer system (e.g., an adhesive transfer method and a pressure transfer method); and a magnetic transfer system can be used.

To a position where the photoconductor 1 and the transferring unit 10 facing each other, the recording medium 9 is transported by a registration roller 8 etc. in a manner that the toner image is to be transferred to a desired position of the recording medium 9.

A separation charger 11 and a separation claw 12 may be used as a unit configured to separate the recording medium 9 from the photoconductor 1 if necessary. As other separating units, electrostatic attraction induced separation, side-edge belt separation, tip-grip conveyance, and self stripping are used. As the separation charger 11, the charging unit can be used. In order to clean the toner remaining on the photoconductor after the image is transferred, a cleaning unit such as a fur brush 14 and a cleaning blade 15 is used. A pre-cleaning charger 13 may be used in order to effectively perform the cleaning. Examples of other cleaning units include a web method and a magnetic brush method. These may be used alone or two or more systems may be used together. A charge-eliminating unit 2 may be used for removing a latent image on the photoconductor 1. Examples of the charge-eliminating unit 2 include a charge-eliminating lamp and a charge-eliminating charger. The exposure light source and the charging unit can be used. As the typically known processes, other processes (e.g. scanning manuscripts, feeding sheets of paper, fixing, and paper ejection, where each of the processes is not adjacent to the photoconductor) can be used.

Process Cartridge

The process cartridge of the present disclosure includes a photoconductor, and at least one selected from the group consisting of a charging unit configured to charge a surface of the photoconductor, an exposing unit configured to expose the surface charged of the photoconductor to light to form an electrostatic latent image, a developing unit configured to develop the electrostatic latent image with a toner to form a visible image, and a transferring unit configured to transfer the visible image onto a recording medium. The process cartridge may further include other units if necessary.

The photoconductor used in the process cartridge of the present disclosure is the above-described photoconductor of the present disclosure.

Figure 4:
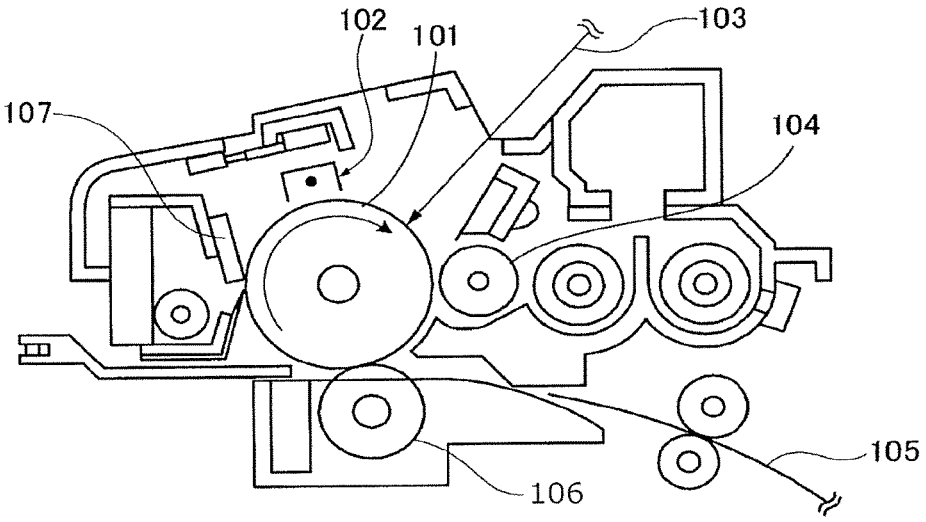
FIG. 4 is a schematic view illustrating one example of a process cartridge of the present disclosure.

As described in FIG. 4, the process cartridge includes a photoconductor 101 and at least one selected from the group consisting of a charging unit 102, a developing unit 104, a transfer unit 106, a cleaning unit 107, and a charge-eliminating unit. The process cartridge is a device (component) that is detachably mounted on a main body of the image forming apparatus. FIG. 4 illustrates an image forming step by a process cartridge. The photoconductor 101 is subjected to charging by the charging unit 102 and is subjected to exposure by the exposing unit 103 while rotated in the direction indicated by the arrow. Then, the electrostatic latent image, which corresponds to an exposure image, is formed on the surface of the photoconductor 101. This electrostatic latent image is developed with the toner by the developing unit 104 to form a developed image. The developed image is transferred onto a recording medium 105 by the transfer unit 106 to be printed out. Then, after the image is transferred, the surface of the photoconductor is cleaned by the cleaning unit 107, and is further charge-eliminated by the charge-eliminating unit. The above procedures are repeated.

EXAMPLES

The present disclosure will be described in detail with reference to the following Examples and Comparative Examples. However, it is noted that the present disclosure is not limited to these Examples. Here, the unit "part(s)" used in Examples means "part(s) by mass" unless otherwise stated.

Preparation of Undercoat-Layer Coating Liquid A

<Preparation of Undercoat-Layer Coating Liquid A-1>

Materials presented below were mixed, and the resultant mixture was stirred by using zirconia beads each having a diameter of 0.5 mm and a vibration mill at 1,500 rpm for 24 hours, to thereby prepare Undercoat-Layer Coating Liquid A-1.

Metal oxide particles: 100 parts (zinc oxide particles having an average primary particle diameter of 50 nm produced by the above-mentioned wet method)

Binder Resin:

Blocked isocyanate: 13 parts (SUMIDUR BL-3175 (solid content: 75%), available from Sumitomo Bayer Urethane Co., Ltd.)

20% by mass solution, in which a butyral resin was dissolved in 2-butanone: 50 parts (butyral resin: BM-1, available from SEKISUI CHEMICAL CO., LTD.)

Salicylic acid derivative: 2 parts

[3,5-di-t-butylsalicylic acid (TCI-D1947, available from TOKYO CHEMICAL INDUSTRY CO., LTD.)]

Solvent (2-butanone): 120 parts

<Preparation of Undercoat-Layer Coating Liquid A-2>

Undercoat-Layer Coating Liquid A-2 was prepared in the same manner as in Undercoat-Layer Coating Liquid A-1, except that the amounts of the binder resin and the salicylic acid derivative were respectively changed as follows.

Binder Resin:

Alkyd resin: 12 parts (BECKOLITE M6401-50, available from DIC Corporation)

Melamine resin: 8 parts (SUPER BECKAMINE G821-60, available from DIC Corporation)

Salicylic acid derivative: 3 parts

<Preparation of Undercoat-Layer Coating Liquid A-3>

Undercoat-Layer Coating Liquid A-3 was prepared in the same manner as in Undercoat-Layer Coating Liquid A-1, except that the salicylic acid derivative was changed to a material below.

Salicylic acid derivative: 2 parts

[3-aminosalicylic acid (TCI-A0421, available from TOKYO CHEMICAL INDUSTRY CO., LTD.)]

<Preparation of Undercoat-Layer Coating Liquid A-4>

Undercoat-Layer Coating Liquid A-4 was prepared in the same manner as in Undercoat-Layer Coating Liquid A-1, except that the salicylic acid derivative was changed to a material below.

Salicylic acid derivative: 1.5 parts

[3,5-dinitrosalicylic acid (TCI-D0850, available from TOKYO CHEMICAL INDUSTRY CO., LTD.)]

<Preparation of Undercoat-Layer Coating Liquid A-5>

Undercoat-Layer Coating Liquid A-5 was prepared in the same manner as in Undercoat-Layer Coating Liquid A-1, except that the salicylic acid derivative was changed to a material below.

Salicylic acid derivative: 1 part

[3-hydroxy-2-naphthoic acid (TCI-B3229, available from TOKYO CHEMICAL INDUSTRY CO., LTD.)]

<Preparation of Undercoat-Layer Coating Liquid A-6>

Undercoat-Layer Coating Liquid A-6 was prepared in the same manner as in Undercoat-Layer Coating Liquid A-1, except that the salicylic acid derivative was not added.

<Preparation of Undercoat-Layer Coating Liquid A-7>

Undercoat-Layer Coating Liquid A-7 was prepared in the same manner as in Undercoat-Layer Coating Liquid A-6, except that the metal oxide particles were replaced with titanium oxide particles (PT-401M, available from ISHIHARA SANGYO KAISHA, LTD.).

<Preparation of Undercoat-Layer Coating Liquid A-8>

Undercoat-Layer Coating Liquid A-8 was prepared in the same manner as in Undercoat-Layer Coating Liquid A-6, except that the metal oxide particles were replaced with zirconium oxide particles (UEP, available from DAIICHI KIGENSO KAGAKU KOGYO CO., LTD.).

<Preparation of Undercoat-Layer Coating Liquid A-9>

Undercoat-Layer Coating Liquid A-9 was prepared in the same manner as in Undercoat-Layer Coating Liquid A-6, except that the metal oxide particles were replaced with tin oxide particles (NanoTek (registered trademark) $SnO_2$, C.I. KASEI CO., LTD.).

<Preparation of Undercoat-Layer Coating Liquid A-10>

Materials below were dissolved with heating to 50° C. to prepare Undercoat-Layer Coating Liquid A-10.

Alcohol-soluble polyamine resin: 40 parts (CM-8000 available from TORAY INDUSTRIES, INC., nylon6/66/610/12copolymer)

Methanol: 500 parts

Butanol: 125 parts

Preparation of Charge-Generating-Layer Coating Liquid B

<Preparation of Charge-Generating-Layer Coating Liquid B-1>

Charge-Generating-Layer Coating Liquid B-1 was prepared in the following manner.

Materials below were mixed, and the resultant mixture was stirred for 8 hours using glass beads each having a diameter of 1 mm and a bead mill to prepare Charge-Generating-Layer Coating Liquid B-1.

Charge-Generating Material:

Titanyl phthalocyanine: 8 parts

Binder Resin:

Polyvinyl butyral: 5 parts (S-LEC BX-1, available from SEKISUI CHEMICAL CO., LTD.)

Salicylic acid derivative: 0.0008 parts

[3,5-di-t-butylsalicylic acid (TCI-D1947, available from TOKYO CHEMICAL INDUSTRY CO., LTD.)]

Solvent (2-butanone): 400 parts

Figure 5:
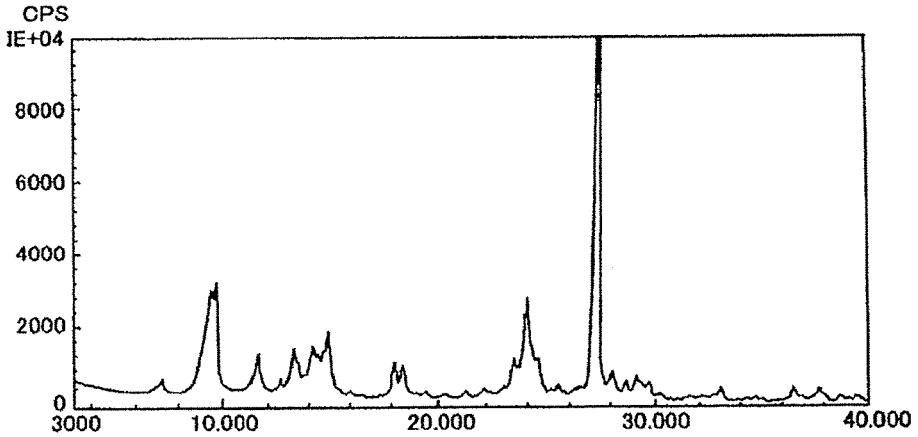
FIG. 5 is a graph presenting an X-ray diffraction spectrum of titanyl phthalocyanine used as a charge-generating material in Examples.

A powder X-ray diffraction spectrum of the titanyl phthalocyanine is presented in FIG. 5. The vertical axis represents CPS, and the horizontal axis represents 2θ.

<Preparation of Charge-Generating-Layer Coating Liquid B-2>

Charge-Generating-Layer Coating Liquid B-2 was prepared in the same manner as in Charge-Generating-Layer Coating Liquid B-1, except that the amount of the salicylic acid derivative was changed to an amount below.

Salicylic acid derivative: 0.008 parts

<Preparation of Charge-Generating-Layer Coating Liquid B-3>

Charge-Generating-Layer Coating Liquid B-3 was prepared in the same manner as in Charge-Generating-Layer Coating Liquid B-1, except that the amount of the salicylic acid derivative was changed to an amount below.

Salicylic acid derivative: 0.08 parts

<Preparation of Charge-Generating-Layer Coating Liquid B-4>

Charge-Generating-Layer Coating Liquid B-4 was prepared in the same manner as in Charge-Generating-Layer Coating Liquid B-1, except that the salicylic acid derivative was changed to a material below.

Salicylic acid derivative: 0.08 parts

[3-aminosalicylic acid (TCI-A0421, available from TOKYO CHEMICAL INDUSTRY CO., LTD.)]

<Preparation of Charge-Generating-Layer Coating Liquid B-5>

Charge-Generating-Layer Coating Liquid B-5 was prepared in the same manner as in Charge-Generating-Layer Coating Liquid B-1, except that the salicylic acid derivative was changed to a material below.

Salicylic acid derivative: 0.12 parts

[3,5-dinitrosalicylic acid (TCI-D0850, available from TOKYO CHEMICAL INDUSTRY CO., LTD.)]

<Preparation of Charge-Generating-Layer Coating Liquid B-6>

Charge-Generating-Layer Coating Liquid B-6 was prepared in the same manner as in Charge-Generating-Layer Coating Liquid B-1, except that the salicylic acid derivative was changed to a material below.

Salicylic acid derivative: 0.24 parts

[3-hydroxy-2-naphthoic acid (TCI-B3229, available from TOKYO CHEMICAL INDUSTRY CO., LTD.)]

<Preparation of Charge-Generating-Layer Coating Liquid B-7>

Charge-Generating-Layer Coating Liquid B-7 was prepared in the same manner as in Charge-Generating-Layer Coating Liquid B-1, except that the salicylic acid derivative was not added.

<Preparation of Charge-Generating-Layer Coating Liquid B-8>

Charge-Generating-Layer Coating Liquid B-8 was prepared in the same manner as in Charge-Generating-Layer Coating Liquid B-1, except that the charge-generating material was changed to a material below, and the amount of the salicylic acid derivative was changed to an amount below.

Charge-Generating Material:

τ-form metal-free phthalocyanine (available from TOKYO INK CO., LTD.): 10 parts

Salicylic acid derivative: 0.1 parts

<Preparation of Charge-Generating-Layer Coating Liquid B-9>

Charge-Generating-Layer Coating Liquid B-9 was prepared in the same manner as in Charge-Generating-Layer Coating Liquid B-1, except that the salicylic acid derivative was changed to a material below.

Colloidal silica: 5 parts

[organosilica sol (MEK-ST, available from NISSAN CHEMICAL INDUSTRIES, LTD.)]

[Preparation of Charge-Transporting-Layer Coating Liquid C]

A charge-transporting-layer coating liquid was prepared in the following manner.

Materials presented below were mixed, and the resultant mixture was stirred until all of the materials were dissolved, to thereby prepare Charge-Transporting-Layer Coating Liquid C.

Charge-Transporting Material:

Charge-transporting material represented by Structural Formula (5) below: 7 parts Binder Resin:

Polycarbonate (TS-2050, available from TEIJIN LIMITED): 10 parts

Leveling Agent:

Silicone oil (KF-50, available from Shin-Etsu Chemical Co., Ltd.): 0.0005 parts

Solvent (tetrahydrofuran): 100 parts

Structural Formula (5)

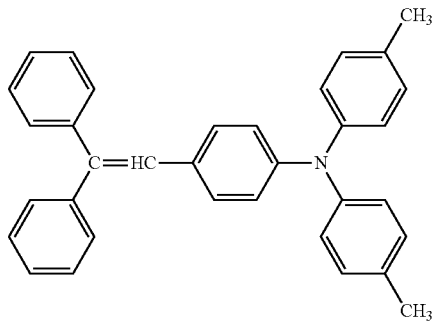

Example 1

After applying Undercoat-Layer Coating Liquid A-1 onto an aluminium cylinder (diameter: 100 mm, length: 380 mm) through dip coating, the applied coating liquid was dried for 30 minutes at 170° C., to form an undercoat layer having an average film thickness of 5 μm disposed on the aluminium cylinder. Next, Charge-Generating-Layer Coating Liquid B-1 was applied by dip coating followed by drying for 30 minutes at 90° C., to form a charge-generating layer having an average film thickness of 0.2 μm disposed on the undercoat layer. Moreover, Charge-Transporting-Layer Coating Liquid C was applied by dip coating, followed by performing drying for 30 minutes at 150° C., to thereby form a charge-transporting layer having an average film thickness of 25 μm disposed on the charge-generating layer. In the manner as described, Photoconductor 1 of Example 1 was produced.

Examples 2 to 9 and Comparative Examples 1 and 2

Photoconductors 2 to 9 of Examples 2 to 9 and Photoconductors 10 to 11 of Comparative Examples 1 and 2 were each produced in the same manner as in Example 1, except that Undercoat-Layer Coating Liquid A, Charge-Generating-Layer Coating Liquid B, and the average thickness of the undercoat layer were changed as presented in Table 1 below.

Comparative Example 3

Photoconductor 12 of Comparative Example 3 was produced in the same manner as in Example 1, except that Undercoat-Layer Coating Liquid A, Charge-Generating-Layer Coating Liquid B, and the average film thickness of the undercoat layer were changed as presented in Table 1 below, and drying was performed for 20 minutes at 90° C. after applying the undercoat-layer coating liquid.

Comparative Example 4

Photoconductor 13 of Comparative Example 4 was produced in the same manner as in Example 1, except that Undercoat-Layer Coating Liquid A, Charge-Generating-Layer Coating Liquid B, and the average film thickness of the undercoat layer were changed as presented in Table 1 below.

Comparative Example 5

Photoconductor 14 of Comparative Example 5 was produced in the same manner as in Example 1, except that Undercoat-Layer Coating Liquid A, Charge-Generating-Layer Coating Liquid B, and the average film thickness of the undercoat layer were changed as presented in Table 1 below.

Comparative Example 6

Photoconductor 15 of Comparative Example 6 was produced in the same manner as in Example 1, except that Undercoat-Layer Coating Liquid A, Charge-Generating-Layer Coating Liquid B, and the average film thickness of the undercoat layer were changed as presented in Table 1 below.

Types of Undercoat-Layer Coating Liquid A, types of Charge-Generating-Layer Coating Liquid B, and the film thicknesses of the undercoat layers used in Examples and Comparative Examples are presented in Table 1 below.

<Measurement of Film Thickness of Undercoat Layer>

A film thickness of each undercoat layer was measured by means of an eddy-current coating thickness tester (FISCHER SCOPE MMS, available from Fischer). An average film thickness of each undercoat layer was calculating an average value of thickness values measured at randomly-selected five points.

TABLE 1

| Example No. | Photo-conductor No. | Undercoat layer coating liquid A | Charge-generating layer coating liquid B | Average thickness of undercoat layer (μm) |
|---|---|---|---|---|
| Ex. 1 | 1 | A-1 | B-1 | 5 |
| Ex. 2 | 2 | A-2 | B-2 | 7 |
| Ex. 3 | 3 | A-3 | B-4 | 10 |
| Ex. 4 | 4 | A-4 | B-5 | 15 |
| Ex. 5 | 5 | A-5 | B-6 | 20 |
| Ex. 6 | 6 | A-6 | B-3 | 10 |
| Ex. 7 | 7 | A-7 | B-3 | 5 |
| Ex. 8 | 8 | A-8 | B-3 | 5 |
| Ex. 9 | 9 | A-9 | B-3 | 20 |
| Comp. Ex. 1 | 10 | A-1 | B-7 | 10 |
| Comp. Ex. 2 | 11 | A-1 | B-8 | 10 |
| Comp. Ex. 3 | 12 | A-10 | B-3 | 0.5 |
| Comp. Ex. 4 | 13 | A-1 | B-9 | 10 |
| Comp. Ex. 5 | 14 | A-6 | B-7 | 10 |
| Comp. Ex. 6 | 15 | A-6 | B-9 | 10 |

(Evaluation)

An evaluation of electrical properties (potential of the exposed area) and an image evaluation (density unevenness) were performed on the photoconductors obtained in Examples and Comparative Examples.

<Evaluation Device>

A modified device of a digital photocopier (RICOH ProC900) available from Ricoh Company Limited was used in Examples 1 to 9 and Comparative Examples 1 to 6.

A test chart (image area rate: 5%) in black single color was continuously output on 500,000 sheets in the environment of 23° C. and 55% RH to make the photoconductor deteriorated.

<Evaluation of Electrical Properties (Potential Difference in Exposed Area)>

A surface potential of the photoconductor was measured in the environment having a temperature of 10° C. and relative humidity of 15% RH, and in the environment having a temperature of 27° C. and relative humidity of 80% RH (HH). Moreover, a surface potential of the photoconductor before and after the deterioration was measured in an environment having a temperature of 23° C. and relative humidity of 55% RH. The measurement of the potential was performed by attaching a potential sensor, which was a sensor obtained by modifying the developing unit of the evaluation device, and setting the unit to the evaluation device, according to a method described below.

—Evaluation of Electrical Properties by RICOH ProC900—

A voltage applied to a wire was −1,800 μA, and a grid voltage was −800 V. A full solid image was printed on 100 sheets of paper (size: A3) in the longitudinal direction, and then the first sheet of paper and the 100th sheet of paper were each measured for a potential (VL) of an exposed area. A surface electrometer (MODEL 344 surface electrometer, available from TREK JAPAN) was used for measurement. An oscilloscope was used to record values obtained by the surface electrometer at 100 signals or more/second to evaluate electrical properties based on the following criteria.

Potential difference (ΔVL1) of an exposed area in the environment having a temperature of 10° C. and relative humidity of 15% RH A: A potential difference (ΔVL1) between a potential of an exposed area of the first sheet of paper and a potential of an exposed area of the 100th sheet of paper was less than 10 V.

B: A potential difference (ΔVL1) between a potential of an exposed area of the first sheet of paper and a potential of an exposed area of the 100th sheet of paper was 10 V or greater but less than 30 V.

C: A potential difference (ΔVL1) between a potential of an exposed area of the first sheet of paper and a potential of an exposed area of the 100th sheet of paper was 30 V or greater.

Potential difference (ΔVL2) of an exposed area in the environment having a temperature of 27° C. and relative humidity of 80% RH A: A potential difference (ΔVL2) between a potential of an exposed area of the first sheet of paper and a potential of an exposed area of the 100th sheet of paper was less than 10 V.

B: A potential difference (ΔVL2) between a potential of an exposed area of the first sheet of paper and a potential of an exposed area of the 100th sheet of paper was 10 V or greater but less than 30 V.

C: A potential difference (ΔVL2) between a potential of an exposed area of the first sheet of paper and a potential of an exposed area of the 100th sheet of paper was 30 V or greater.

Potential difference (ΔVL3) of an exposed area before the deterioration of photoconductor and potential difference (ΔVL4) of an exposed area after the deterioration of the photoconductor in the environment having a temperature of 23° C. and relative humidity of 55% RH A: A potential difference (ΔVL3 and ΔVL4) between a potential of an exposed area of the first sheet of paper and a potential of an exposed area of the 100th sheet of paper was less than 10 V.

B: A potential difference (ΔVL3 and ΔVL4) between a potential of an exposed area of the first sheet of paper and a potential of an exposed area of the 100th sheet of paper was 10 V or greater but less than 30 V.

C: A potential difference (ΔVL3 and ΔVL4) between a potential of an exposed area of the first sheet of paper and a potential of an exposed area of the 100th sheet of paper was 30 V or greater.

Difference (ΔVL5) between a potential of an exposed area at the 100th sheet in the environment having a temperature of 10° C. and relative humidity of 15% RH and a potential of an exposed area at the 100th sheet in the environment having a temperature of 27° C. and relative humidity of 80% RH A: A potential difference (ΔVL5) of an exposed area was less than 20 V.

B: A potential difference (ΔVL5) of an exposed area was 20 V or greater but less than 40 V.

C: A potential difference (ΔVL5) of an exposed area was 40 V or greater.

<Image Evaluation>

Before and after the deterioration of the photoconductor, an image was output in the environment having a temperature of 23° C. and relative humidity of 55% RH, and density unevenness of the images were evaluated.

The density unevenness was evaluated by visually evaluating unevenness of image density on the first sheet and the 100th sheet, when a half-tone image was continuously output on 100 sheets.

A: No image density unevenness was observed.

B: Density unevenness of a level which was not problem on practical use was observed.

C: Image density unevenness was clearly observed.

The evaluation results of the above-described evaluations are presented in Table 2 below.

TABLE 2

| Example | Potential of exposed area | | | | | Density unevenness evaluation | |
|---|---|---|---|---|---|---|---|
| | | | | | | Before | After |
| No. | ΔVL1 | ΔVL2 | ΔVL3 | ΔVL4 | ΔVL5 | deterioration | deterioration |
| Ex. 1 | A | A | A | A | A | A | A |
| Ex. 2 | A | A | A | A | A | A | A |
| Ex. 3 | A | A | A | B | A | A | A |
| Ex. 4 | A | A | A | B | A | A | A |
| Ex. 5 | A | A | A | B | A | A | B |
| Ex. 6 | B | A | A | B | A | A | B |
| Ex. 7 | B | A | A | B | B | A | B |
| Ex. 8 | B | A | B | B | B | A | B |
| Ex. 9 | B | A | A | B | B | A | B |
| Comp. Ex. 1 | B | B | A | B | C | B | C |
| Comp. Ex. 2 | C | B | B | B | C | B | C |
| Comp. Ex. 3 | C | B | B | C | C | B | B |
| Comp. Ex. 4 | B | B | B | C | B | B | C |
| Comp. Ex. 5 | C | B | B | C | C | B | C |
| Comp. Ex. 6 | B | B | B | C | C | B | C |

For example, embodiments of the present disclosure are as follows.

<1> A Photoconductor Including:

a conductive support;

an undercoat layer;

a charge-generating layer; and a charge-transporting layer, at least the undercoat layer, the charge-generating layer, and the charge-transporting layer being disposed on the conductive support in an order mentioned, wherein the undercoat layer includes a binder resin and metal oxide particles, and the charge-generating layer includes a binder resin, a titanyl phthalocyanine pigment, and a salicylic acid derivative.

<2> The photoconductor according to <1>, wherein the metal oxide particles are zinc oxide particles.

<3> The photoconductor according to <1> or <2>, wherein the undercoat layer includes a salicylic acid derivative.

<4> An image forming apparatus including:

a photoconductor;

a charging unit configured to charge a surface of the photoconductor;

an exposing unit configured to expose the surface charged of the photoconductor to light to form an electrostatic latent image;

a developing unit configured to develop the electrostatic latent image with a toner to form a visible image; and a transferring unit configured to transfer the visible image onto a recording medium, wherein the photoconductor is the photoconductor according to any one of <1> to <3>.

<5> A Process Cartridge Including:

a photoconductor; and at least one selected from the group consisting of:

a charging unit configured to charge a surface of the photoconductor;

an exposing unit configured to expose the surface charged of the photoconductor to light to form an electrostatic latent image;

a developing unit configured to develop the electrostatic latent image with a toner to form a visible image; and a transferring unit configured to transfer the visible image onto a recording medium, wherein the photoconductor is the photoconductor according to any one of <1> to <3>.

The photoconductor according to any one of <1> to <3>, the image forming apparatus according to <4>, and the process cartridge according to <5> can solve the above-described various problems existing in the art, and can achieve the object of the present disclosure.

What is claimed is:

1. A photoconductor comprising:

a conductive support;

an undercoat layer;

a charge-generating layer; and a charge-transporting layer, wherein at least the undercoat layer, the charge-generating layer, and the charge-transporting layer are disposed on the conductive support in that order, wherein the undercoat layer comprises a binder resin, and metal oxide particles, and a salicylic acid derivative, wherein metal oxide particles comprise at least one oxide selected from the group consisting of titanium oxide, zinc oxide, tin oxide, and zirconium oxide, wherein the charge-generating layer comprises a binder resin, a titanyl phthalocyanine pigment, and a salicylic acid derivative, wherein the salicylic acid derivative comprised in the charge-generating layer is at least one selected from the group consisting of 3,5-di-t-butylsalicylic acid, 3-aminosalicylic acid, and 3,5-dinitrosalicylic acid, and wherein the salicylic acid derivative comprised in the undercoat layer is at least one selected from the group consisting of 3,5-di-t-butylsalicylic acid, 3-aminosalicylic acid, and 3,5-dinitrosalicylic acid, wherein an amount of the salicylic acid derivative in the undercoat layer is from 1 part by mass to 3 parts by mass, based on 100 parts by mass of metal oxide particles.

2. The photoconductor according to claim 1, wherein the metal oxide particles are zinc oxide particles.

3. An image forming apparatus comprising:

a photoconductor;

a charging unit configured to charge a surface of the photoconductor;

an exposing unit configured to expose the surface charged of the photoconductor to light to form an electrostatic latent image;

a developing unit configured to develop the electrostatic latent image with a toner to form a visible image; and a transferring unit configured to transfer the visible image onto a recording medium, wherein the photoconductor is the photoconductor according to claim 1.

4. A process cartridge comprising:

a photoconductor; and at least one selected from the group consisting of:

a charging unit configured to charge a surface of the photoconductor;

an exposing unit configured to expose the surface charged of the photoconductor to light to form an electrostatic latent image;

a developing unit configured to develop the electrostatic latent image with a toner to form a visible image; and a transferring unit configured to transfer the visible image onto a recording medium, wherein the photoconductor is the photoconductor according to claim 1.

* * * * *